United States Patent [19]

Sarricola, Jr.

[11] Patent Number: 4,823,669

[45] Date of Patent: Apr. 25, 1989

[54] TREMOLO DEVICE FOR AN ELECTRIC GUITAR

[76] Inventor: William Sarricola, Jr., 3533 George St., Franklin Park, Ill. 60131

[21] Appl. No.: 209,693

[22] Filed: Jun. 21, 1988

[51] Int. Cl.[4] ..... G10D 3/12
[52] U.S. Cl. ..... 84/313; 84/267
[58] Field of Search ..... 84/267, 313

[56] References Cited

U.S. PATENT DOCUMENTS

| | | | |
|---|---|---|---|
| 4,171,661 | 10/1979 | Rose | 84/313 |
| 4,285,262 | 8/1981 | Scholz | 84/313 |
| 4,497,236 | 2/1985 | Rose | 84/298 |
| 4,555,970 | 12/1985 | Rose | 84/313 |

FOREIGN PATENT DOCUMENTS

| | | | |
|---|---|---|---|
| 2587528 | 3/1987 | France | 84/313 |

*Primary Examiner*—Lawrence R. Franklin
*Attorney, Agent, or Firm*—Neuman, Williams, Anderson & Olson

[57] ABSTRACT

A tremolo device comprising a base connected to an electric guitar, a clamp for holding and restraining the guitar strings, a handle for manipulating the device, a spring block connected to the base, a first support connected to the guitar, a first spring connecting the first support to the spring block and forcing the spring block toward the first support, a second support connected to the guitar, an elongated member having first and second ends, the first end connected to the second support and the second end contacting the spring block, and a second spring for forcing the second end of the elongated member against the spring block.

7 Claims, 1 Drawing Sheet

TREMOLO DEVICE FOR AN ELECTRIC GUITAR

BACKGROUND OF THE INVENTION

This invention is directed generally to an electric guitar and more particularly to an improved block tremolo device for use with an electric guitar. Guitarists frequently want to create a musical effect known as tremolo, the temporary altering of string pitch. The device of the present invention provides a mechanical means to accomplish this musical effect. The device also adds both sustain and harmonics.

An electric guitar generally comprises a neck and a body. Near the top of the neck is the nut. Beyond the nut are several tuning pegs, one for each string. The strings extend down from the tuning pegs to the nut and down to a bridge element which is on the body of the guitar. The bridge element may be a tremolo device. Between the nut and the bridge, electrical pickup points are located on the body of the guitar under each of the strings. Unlike acoustic guitars, electric guitars depend on the mass of the guitar body to provide sustain and harmonics for the notes. It is well known in the guitar art that both sustain and harmonics add to better sound and guitar versatility.

An electric guitar can be equipped with a tremolo device. The purpose of a tremolo device is to allow the guitarist to momentarily alter string pitch. The range of sound which the guitarist is able to accomplish with tremolo devices is very important and useful to guitarists. The tremolo effect is desirable in nearly every style of music and virtually every electric guitar sold at present is equipped with a tremolo device.

There are various block tremolo devices known to those skilled in the guitar art. Block tremolo devices allow a guitarist to momentarily alter string tone by allowing the guitarist to vary the tension on the strings. Increasing tension on the guitar strings will raise the pitch of a string. Conversely, decreasing tension on the strings will lower the pitch of a string.

Tremolo devices can take a number of different configurations. Generally, a block tremolo device comprises a base which is connected to the guitar body, string restraining and holding means, a handle for manipulating the tremolo device, and a tremolo spring block which extends into a cavity in the guitar body. The prior art block tremolo devices can be divided into two general categories: floating block tremolos and one-way fixed block tremolos.

Floating block tremolos have springs which exert tensile force on the tremolo spring block in an attempt to return the spring block, and thus the tremolo device, to the position where the strings are in perfect tune. Thus, the springs exert the force necessary to return the tremolo device to its former position. The springs on floating block tremolos, however, do not exert any compressive force on the spring block. Thus, the spring block "floats" when the tremolo device is used to increase string tension. Due to this floating action, the guitar cannot remain in perfect tune. The extended use of a floating block tremolo device, causes the tremolo device to return to a position different from its original position. The result of this position change is that the guitar strings do not remain in tune. The problem is especially severe after extended use, when a string is broken, or when the tremolo device is used heavily. Moreover, if the guitarist's hand rests heavily on the handle of a floating block tremolo device, unintended string pitch changes can occur.

One-way fixed block tremolo devices, like the floating block tremolo devices, include springs intended to return the tremolo spring block to its proper position. However, unlike the floating block tremolo devices, the fixed block devices use a solid block or the guitar body itself to restrain the spring block from moving in the direction necessary for the tremolo device to increase tension on the guitar strings. Although this structure allows for precise positioning of the tremolo spring block and hence the tremolo device, these one-way fixed block tremolo devices are limited because the guitarist cannot use the tremolo device to raise the pitch of the strings.

SUMMARY OF THE INVENTION

This invention provides an improved tremolo device for an electric guitar whereby the tremolo device is returned to the proper position where the strings are in perfect tune even under the most severe use and abuse. In addition, the device adds both sustain and harmonics to the guitar. The present invention is adjustable to any guitarist's playing style including the preferred string pull, response, action, and tremolo device feel. String pitch is not altered unless the guitarist intends to do so no matter how heavily the guitarist's hand rests on the handle of the tremolo device.

The present invention comprises a block tremolo device including a base connected to the guitar body, a clamp for holding and restraining the guitar strings, a handle for manipulating the device, and a tremolo spring block which extends into a cavity in the guitar. The invention also comprises a first support connected to the guitar, springs which connect the first support to the tremolo spring block and force the spring block toward the first support. The invention further comprises a second support connected to the guitar. An elongated member is provided. One end of the elongated member is connected to the second support and the other end is in contact with the tremolo spring block. A spring forces the second end of the elongated member against the spring block to return the spring block to the position where the guitar strings are in perfect tune and to maintain direct contact between the elongated member and the spring block.

The block tremolo device can be used either to increase or decrease the pitch of the strings and the tremolo device returns to the proper position of perfect string tune even under severe use or abuse including when a string breaks. Furthermore, the direct contact from spring block to elongated member to second support adds a positive connection between the tremolo device and the body of the guitar, providing both sustain and harmonics.

BRIEF DESCRIPTION OF THE DRAWINGS

For a more complete understanding of this invention, reference should now be made to the embodiment of the present invention illustrated in greater detail in the accompanying drawings.

DETAILED DESCRIPTION OF THE DRAWINGS

Figure 1:
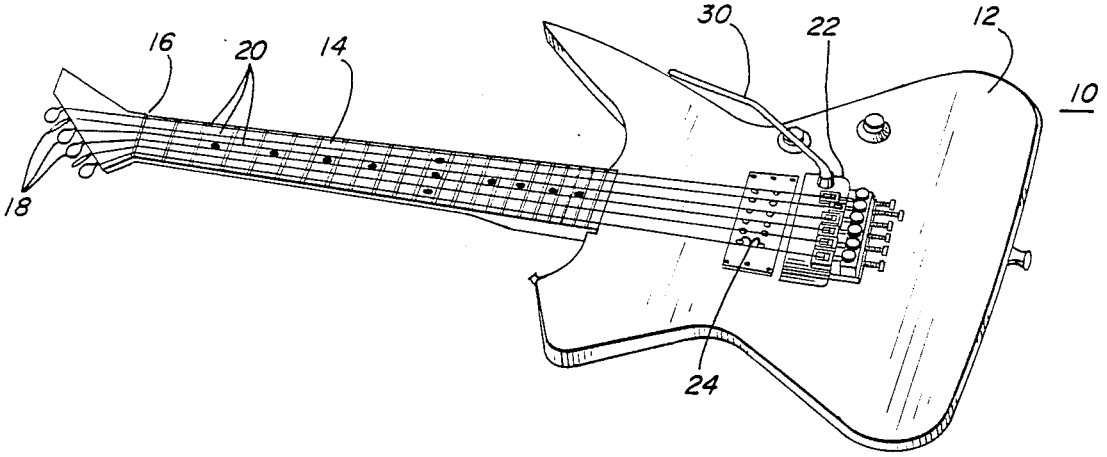
FIG. 1 is a perspective view of a guitar with a block tremolo device.

As seen in FIG. 1, an electric guitar 10 comprises generally a body 12 and a neck 14. Near the top of the neck 14 is the nut element 16. Beyond the nut element 16 are several tuning pegs 18, one for each string 20. The strings 20 extend from the tuning pegs 18 to the block tremolo device 22. The tremolo device 22 may or may not be of the type which allows fine tuning of the strings. Electrical pickup contacts 24 are positioned on the body 12 below the strings 20.

Figure 2:
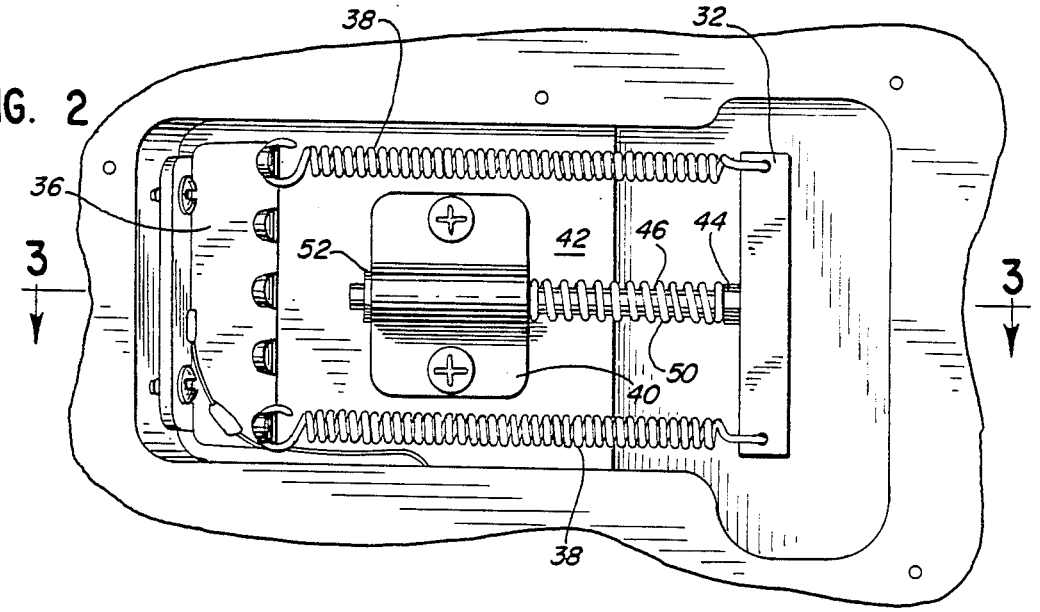
FIG. 2 is a schematic cross-sectional view of the block tremolo device of the present invention.

As seen in FIGS. 1 and 2, the block tremolo device 22 generally comprises a base 26 which is connected to the guitar body 12, a clamp 28 for holding and restraining the strings 20, a handle 30 for manipulating the tremolo device 22, and a tremolo spring block 32 which extends down into a cavity 34 in the body 12 of the guitar.

When a guitarist wants to create a tremolo effect, the guitarist uses the handle 30 to manipulate the tremolo device 22. The tremolo device 22 can be used to raise string pitch by increasing spring tension or lower string pitch by decreasing spring tension. When the tremolo device 22 is used to increase tension and raise string pitch, the spring block 32 is deflected toward the neck 14 of the guitar, i.e. to the left as seen in FIG. 2. Conversely, when string pitch is lowered, the spring block moves away from the neck 14, i.e. to the right as seen in FIG. 2.

Figure 3:
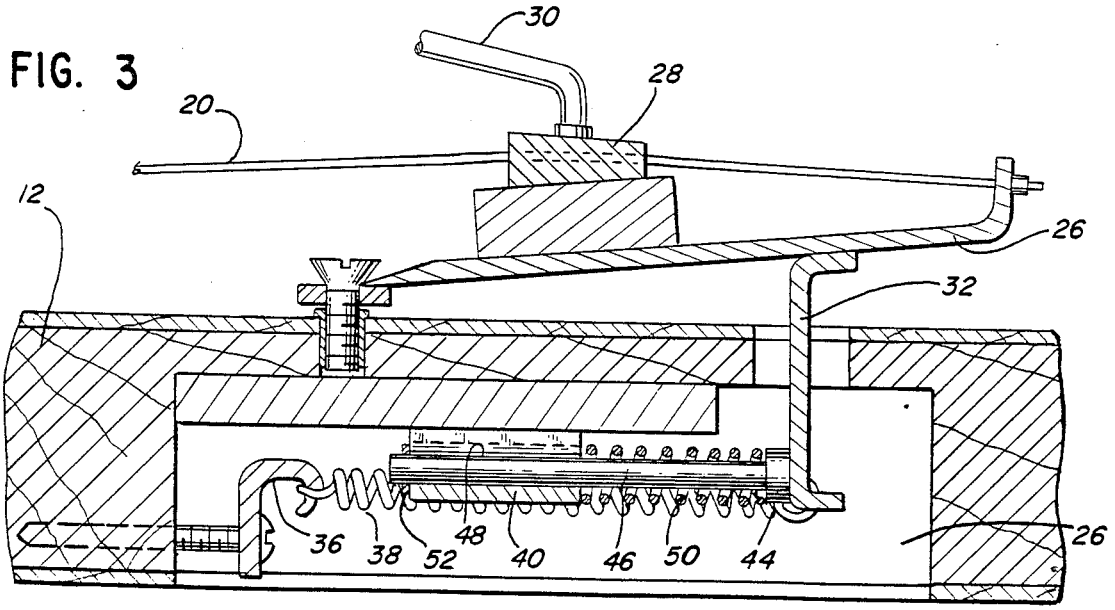
FIG. 3 is a schematic view of the block tremolo device of the present invention as seen when the rear guitar cover plate is removed.

As shown in FIGS. 2 and 3, the tremolo device of the present invention provides precise positioning of the tremolo device. In addition to the above recited elements, the tremolo device 22 includes elements for properly repositioning the tremolo device 22 after use. These elements include a first support 36 which is connected to the body 12 of the guitar 10. Connected to the first support are tension springs 38. The tension springs 38 have one end connected to the first support 36 and the other end connected to the tremolo spring block 32. The tension springs 38 thus exert a tension force on the tremolo spring block 32, returning the spring block to its proper position after the tremolo device 22 has been used to decrease tension on the strings 20.

A second support 40 is also connected to the body 12 of the guitar. An elongated member 42 has a head 44 of larger cross-section than the cross-section of the body 46 of the elongated member 42. The head 44 contacts the tremolo spring block 32. The other end of the elongated member 42 is connected to the second support 40 by inserting the body 46 in a bore 48 in the second support 40. The bore 48 is shaped to snugly surround the body 46 of the elongated member 42 while still allowing the body 46 to slide in the bore 48. A compression spring 50 is located around the exterior of the body 46 of the elongated member 42. The compression spring 50 is restrained by the enlarged head 44 and by the second support 40. In a preferred embodiment, clip 52 is engaged on elongated member 42 in order to assure that the elongated member 42 remains in contact with the second support 40 and to provide a positive stop point for the tremolo spring block 32.

The combination of the second support 40, the elongated member 42, and the compression spring 48 exerts a compressive force on the tremolo spring block 32 which repositions the tremolo spring block 32 and then the tremolo device 22 after it has been used to raise the pitch of a string 20. The compression spring 48 forces the head 44 of the elongated member 42 against the spring block 32 no matter what the position of the tremolo device. This provides a direct connection from the spring block 32 to the elongated member 42. The elongated member 42 is directly connected to the second support 40. The second support 40 is connected to the guitar.

This structure adds a direct positive connection from the tremolo device 22 to the guitar 10 providing sustain and harmonics. In order to obtain this effect, the elongated member 42, compression spring 48, and second support 40, must be constructed of a material, such as metal, which allows the direct contact to add to the sustain and harmonics. It is preferred to manufacture the second support 40 from brass and the elongated member 42 from steel. This combination provides the proper frictional coefficients to allow free movement of the elongated member 42 as it remains in contact with the spring block 32.

Both the two tension springs 38 and the compression spring 48 are designed so that the respective spring constants of these springs remain substantially fixed over a period of time. It is also desirable to choose the tension springs 38 and compression spring 48 so that the relative spring constants are such that the forces exerted on the tremolo spring block 32 are relatively equal. However, the device of the present invention will be operative no matter what the relative spring constants so long as the guitar is tuned after the device is in place.

Having described the invention what is claimed is:

1. A positioning device for maintaining the tuning of strings on an electric guitar with a block tremolo device having a spring block, said positioning device comprising:

a first support means connected to the guitar;

first spring means connecting said first support means to the spring block and forcing the spring block toward said first support means;

a second support means connected to the guitar body;

an elongated member having first and second ends, said first end connected to said second support means, and said second end contacting the spring block; and second spring means for forcing said second end of said elongated member against the spring block.

2. The positioning device of claim 1 wherein said second end of said elongated member is enlarged when compared to said first end of said elongated member.

3. The positioning device of claim 1 wherein the guitar contains a cavity and said first support means and said second support means are mounted inside the

4. The positioning device of claim 1 wherein said second support means is a base plate member having a bore therein adapted to receive said first end of said elongated member.

5. A tremolo device for use on an electric guitar for maintaining the tuning of guitar strings comprising:

a base connected to the guitar;

string restraining and holding means on said base;

handle means connected to said base for manipulating the device;

a spring block connected to said base;

a first support means connected to the guitar;

first spring means connecting said first support means to said spring block forcing said spring block toward said first support means;

a second support means connected to the guitar body;

an elongated member having first and second ends, said first end connected to said second support means, and said second end contacting said spring block;

second spring means for forcing said second end of said elongated member against said spring block;

clip means engaged on said elongated member for retaining said elongated member in contact with said second support.

6. The tremolo device of claim 5 wherein said second end of said elongated member is enlarged when compared to said first end of said elongated member.

7. The tremolo device of claim 5 wherein the guitar contains a cavity said tremolo spring block extending into the cavity and said first support means and said second support means are mounted inside the cavity.

* * * * *

UNITED STATES PATENT AND TRADEMARK OFFICE

CERTIFICATE OF CORRECTION

PATENT NO. : 4,823,669

DATED : April 25, 1989

INVENTOR(S) : William Sarricola, Jr.

It is certified that error appears in the above-identified patent and that said Letters Patent is hereby corrected as shown below:

In Column 4, line 50, after "the" insert --cavity.--.

Signed and Sealed this

Tenth Day of October, 1989

*Attest:*

*Attesting Officer*

DONALD J. QUIGG

*Commissioner of Patents and Trademarks*